US005904113A

United States Patent [19]

Slikkers

[11] Patent Number: 5,904,113

[45] Date of Patent: May 18, 1999

[54] BOAT HAVING A PERSONAL WATERCRAFT STORAGE SYSTEM

[75] Inventor: David A. Slikkers, Holland, Mich.

[73] Assignee: S2 Yachts Inc., Holland, Mich.

[21] Appl. No.: 08/831,135

[22] Filed: Apr. 1, 1997

Related U.S. Application Data

[ 60] Provisional application No. 60/014,581, Apr. 1, 1996.

[51] Int. Cl.[6] ..... B63B 35/40

[52] U.S. Cl. ..... 114/259; 114/263; 114/343

[58] Field of Search ..... 114/259, 365, 114/368, 343, 258, 362, 363

[56] References Cited

U.S. PATENT DOCUMENTS

| | | | |
|---|---|---|---|
| 3,143,991 | 8/1964 | Anderson | 114/365 |
| 3,216,388 | 11/1965 | Smith | 114/365 |
| 4,148,465 | 4/1979 | Bowman | 114/368 |
| 5,483,912 | 1/1996 | Thomas | 114/259 |
| 5,641,242 | 6/1997 | Riviere | 114/263 |

*Primary Examiner*—Sherman Basinger
*Attorney, Agent, or Firm*—Price, Heneveld, Cooper, DeWitt & Litton

[57] ABSTRACT

A personal watercraft storage system for use in a boat includes a winch support stand which cooperates with one or more roller brackets for drawing the personal watercraft onto or off of a support surface. Preferably, brackets are mounted on the port and starboard edges of the swim platform and the winch support stand can be quickly and easily positioned on either of the brackets depending upon the desired position of the personal watercraft. A winch provided on the support stand provides the mechanical advantage needed to move the personal watercraft.

18 Claims, 5 Drawing Sheets

BOAT HAVING A PERSONAL WATERCRAFT STORAGE SYSTEM

CROSS-REFERENCE TO RELATED APPLICATION

This application claims the benefit of U.S. Provisional Application Ser. No. 60/014,581 filed Apr. 1, 1996.

BACKGROUND OF THE INVENTION

1. Field of the Invention

This invention relates to boats and, more particularly, to a system for quickly and easily storing a personal watercraft on the swim platform thereof.

2. Description of the Related Art

Boats have long incorporated swim platforms mounted to the stern of the boat hull, and in view of the dramatic increase in the popularity of personal watercraft, the swim platform is now often being used as a storage site for one or more personal watercraft. Generally, most swim platforms are positioned at or above the water line, and therefore, storing a personal watercraft on the swim platform requires some means for lifting or dragging the personal watercraft up onto the platform. One known means for raising and lowering personal watercraft is a davit arm pivotally mounted to the swim platform or the boat. Typically, the davit is adapted to swing out, over at least a portion of the personal watercraft, and through means such as a winch and cable, raise at least a portion of the personal watercraft for receipt onto the swim platform.

An alternative to the conventional davit arm is a sub-platform or framework which is raised or lowered by motive means such as hydraulics or an electric motor. In this case, the sub-platform would extend outwardly beyond the swim platform and be adapted to be lowered into the water for slideably receiving at least a portion of the personal watercraft. Once the personal watercraft was received on the sub-platform, then the sub-platform and personal watercraft could be raised out of the water.

Still another alternative to the mechanical means for positioning a personal watercraft on the swim platform described above is the use of brute force to drag the personal watercraft onto the swim platform. In view of the fact that most personal watercraft weigh in excess of 500 pounds, the drawbacks of this option are obvious.

The known mechanical systems for positioning a personal watercraft on a swim platform suffer from several problems. First, each of the known systems is fairly large and oftentimes permanently installed in or on the boat. Therefore, these articles could limit the use of the boat during periods in which the mechanisms are not in use. In addition, these known mechanical means require tapping into the boat's electrical and perhaps hydraulic systems. This results in added cost and weight for the boat and further complicates these operating systems.

The personal watercraft storage system according to the invention overcomes the problems of the prior art by creating a very simple and efficient mechanical means for drawing a personal watercraft onto the swim platform without requiring the inclusion of expensive electrical or hydraulic mechanisms. In addition, the bulk of the structure can be quickly and easily stored when not in use.

SUMMARY OF THE INVENTION

The personal watercraft storage system according to the invention overcomes the problems of the prior art by providing a system which can be quickly and easily installed, occupies a minimum of space on the boat, and allows the user to quickly and easily pull or lower a personal watercraft onto or off of a swim platform.

In one aspect, the invention comprises a boat having a swim platform mounted to the hull thereof. The swim platform has a trailing edge and a pair of opposed side edges. A roller is mounted to one of the side edges of the swim platform, and a bracket is also mounted to the swim platform. Preferably, the bracket is mounted opposite the roller. A winch mechanism is removably mounted to the bracket and adapted to create a force to be exerted on a personal watercraft. Preferably, a rope is connected to the personal watercraft and provided on the winch mechanism. The winch mechanism is actuated to draw the personal watercraft over the roller and up onto the swim platform. Once the personal watercraft is properly positioned, the winch mechanism can be removed from the bracket and stored. When the user desires to unload the personal watercraft from the swim platform, the user can push the personal watercraft over the roller and into the water. In order to control the unloading of the personal watercraft, the rope can be reattached to the winch mechanism and the personal watercraft so that the personal watercraft can be lowered into the water by easing out the rope from the personal watercraft.

BRIEF DESCRIPTION OF THE DRAWINGS

The invention will now be described with reference to the drawings in which.

DETAILED DESCRIPTION OF THE PREFERRED EMBODIMENTS

Figure 1:
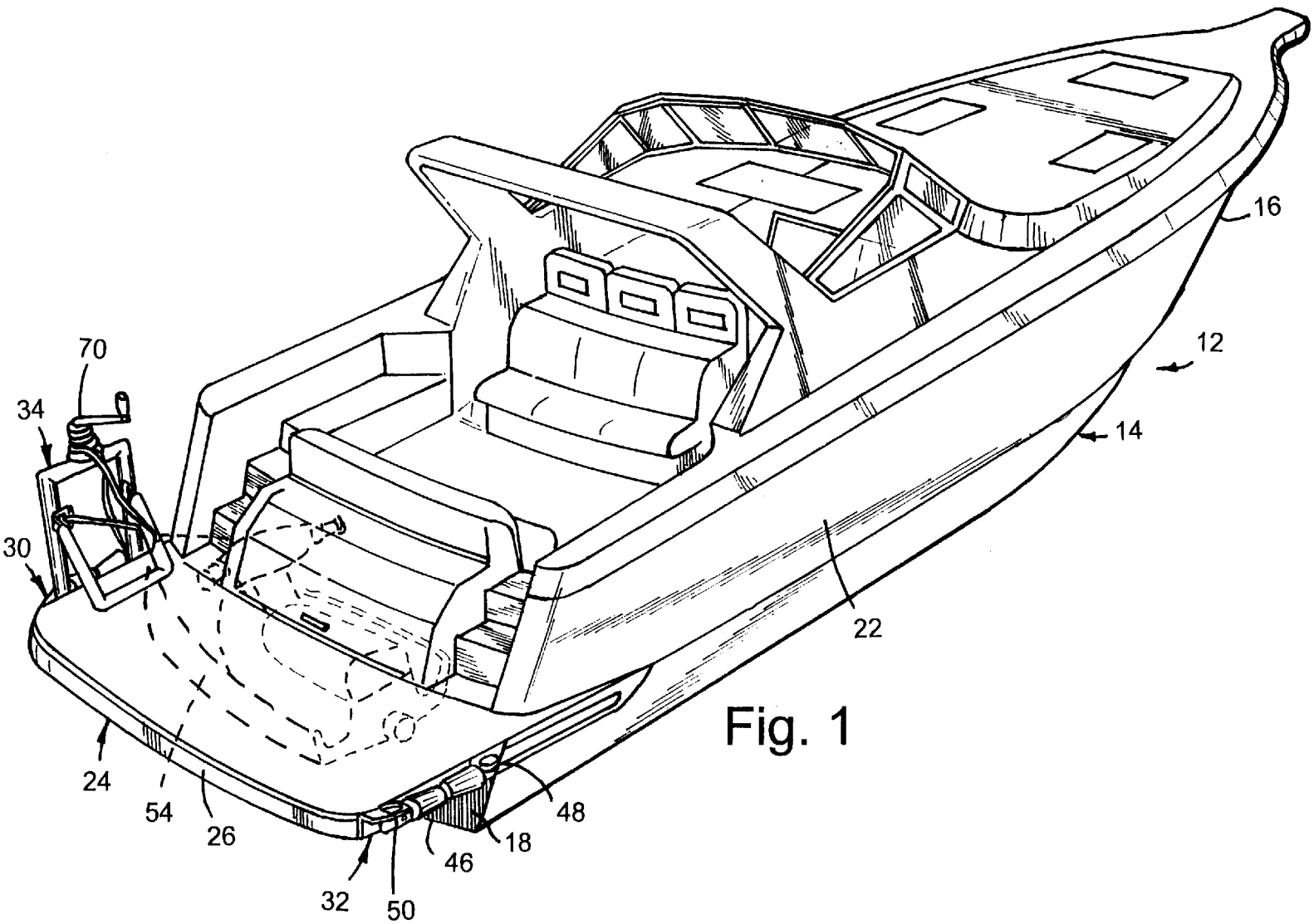
FIG. 1 is a rear perspective view of a boat incorporating the personal watercraft storage system according to the invention.
Figure 2:
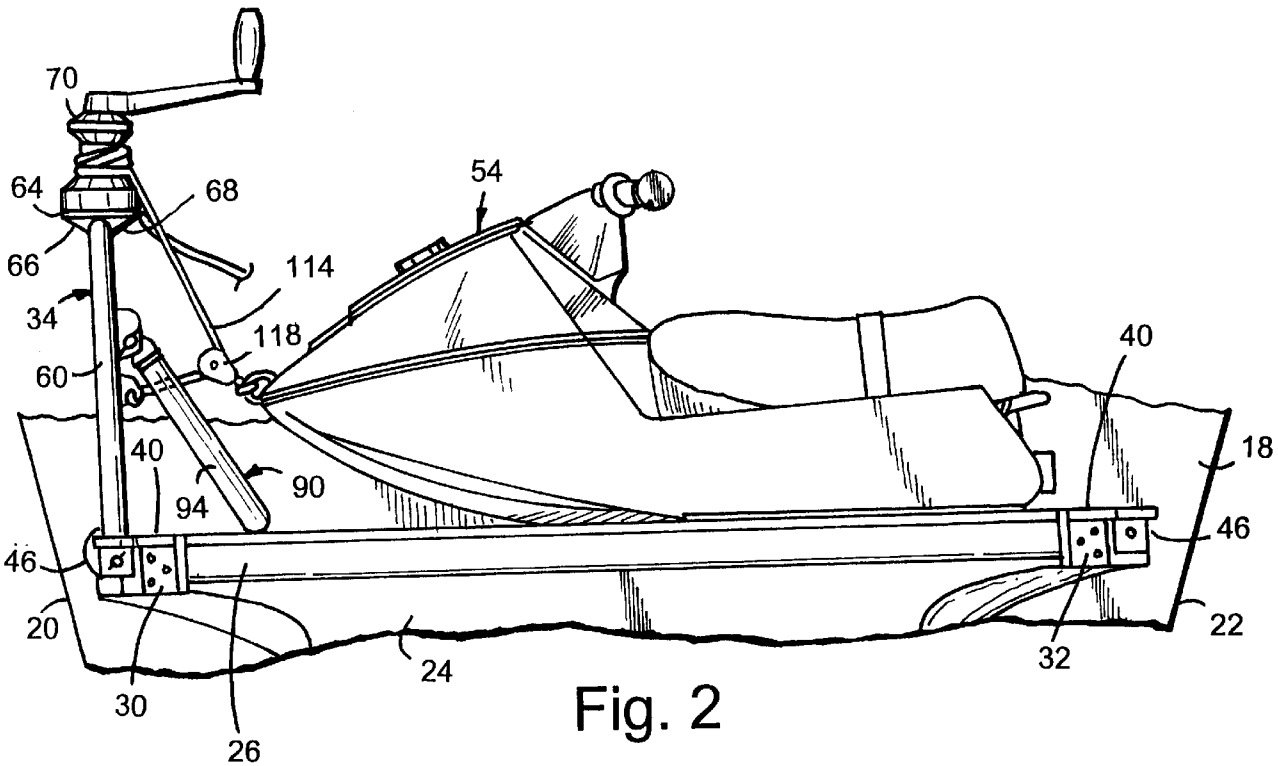
FIG. 2 is a rear elevational view of the boat of FIG. 1 showing a personal watercraft received on the swim platform.

Referring now to the drawings and to FIG. 1 in particular, a boat 12 having a personal watercraft storage system according to the invention is shown. The boat 12 comprises a hull 14 having a bow 16, a stern 18, a port side 20 (FIG. 2), and a starboard side 22. A swim platform 24 is securely mounted to the stern 18 and port and starboard sides 20, 22. The preferred embodiment of the boat and swim platform structure is described more fully in U.S. patent application Ser. No. 08/250,362, filed May 27, 1994 now U.S. Pat. No. 5,572,944. While this is the preferred structure for the boat, the personal watercraft storage system according to the invention can be incorporated on any suitable surface provided on the boat.

The personal watercraft storage system according to the invention preferably comprises a pair of port and starboard roller brackets 30, 32 securely mounted to the sidewall 26 of the swim platform 24 and a winch support stand 34 selectively mounted to either of the port or starboard roller brackets 30, 32.

Figure 4:
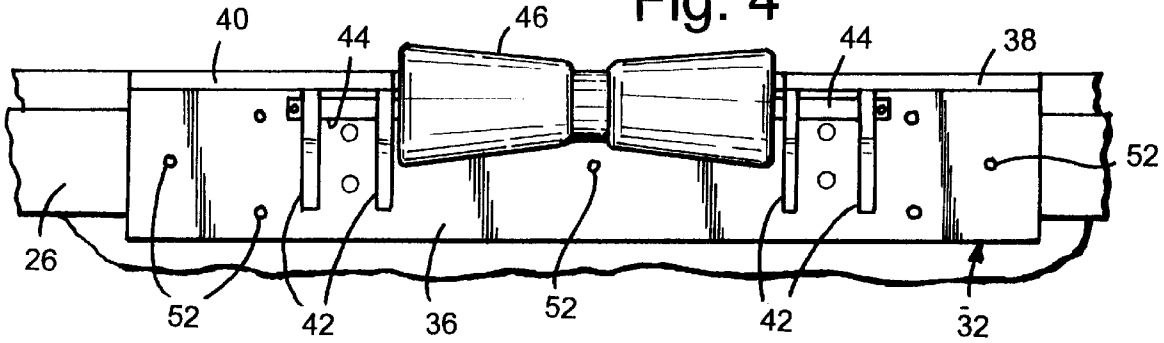
FIG. 4 is a partial side elevational view of the roller bracket mounted to the side of the swim platform.
Figure 3:
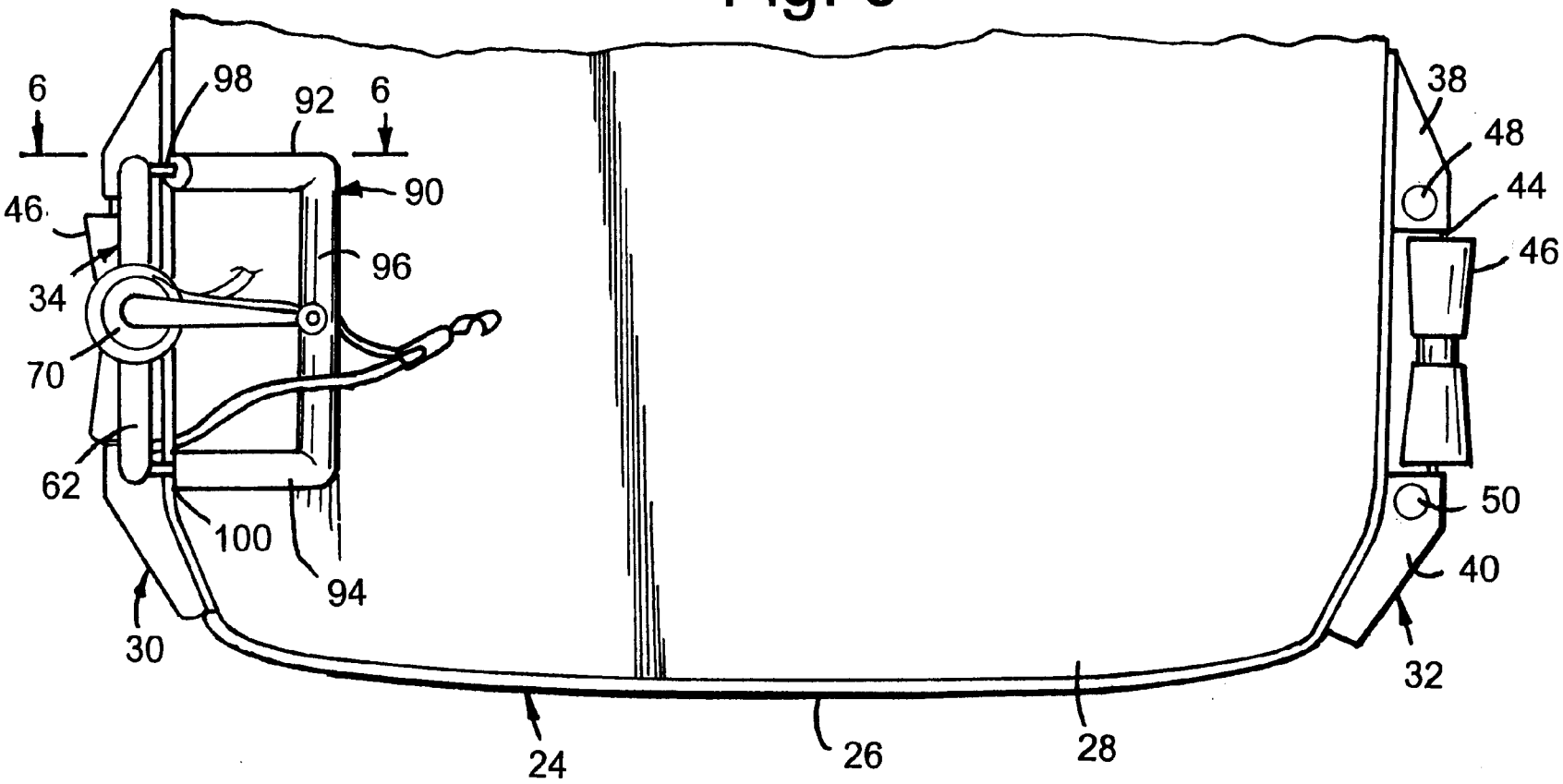
FIG. 3 is a top plan view of the boat of FIG. 1 with the personal watercraft removed therefrom.
Figure 5:
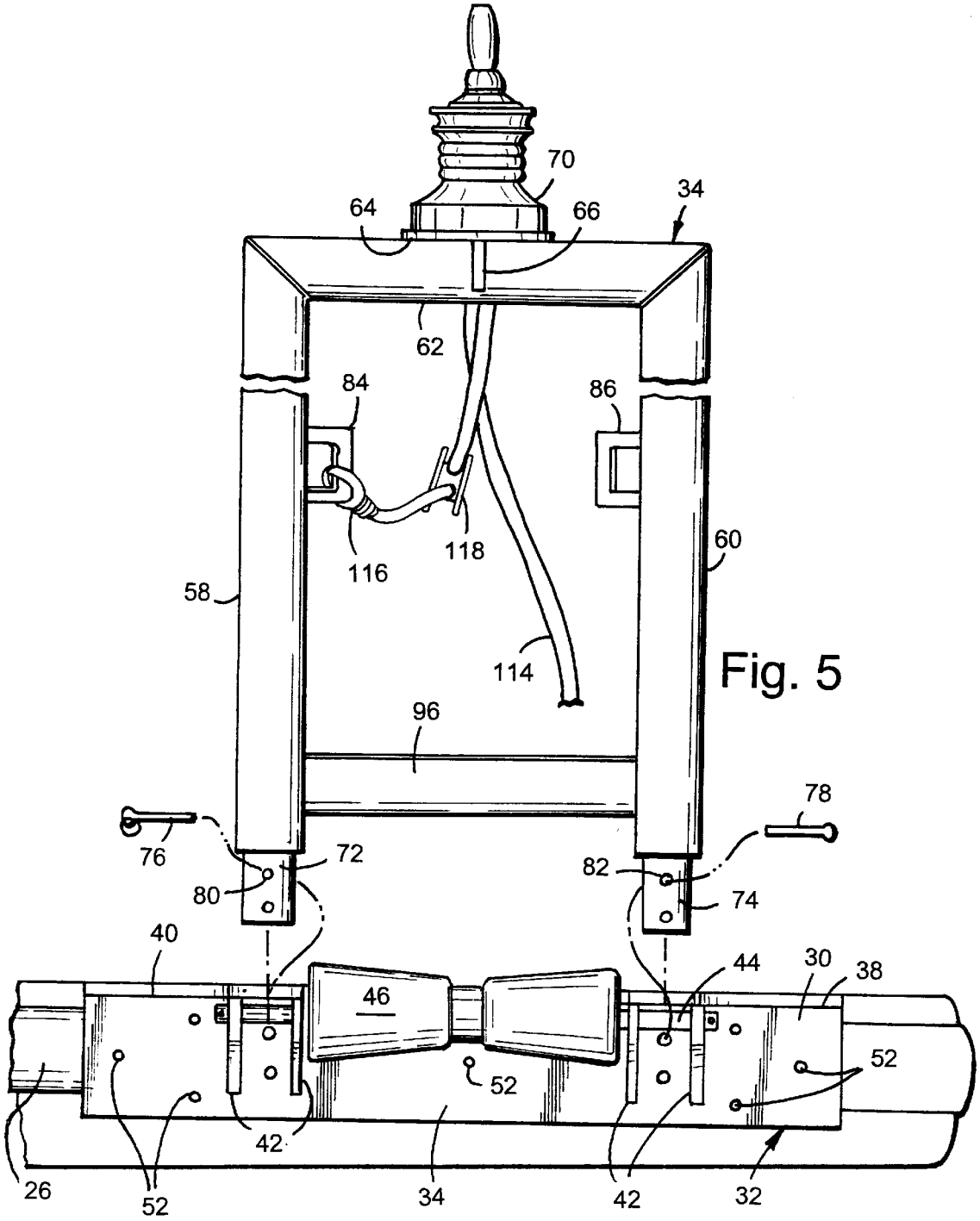
FIG. 5 is a partial side elevational view of the swim platform showing the roller bracket and the support framework mounted thereto.
Figure 6:
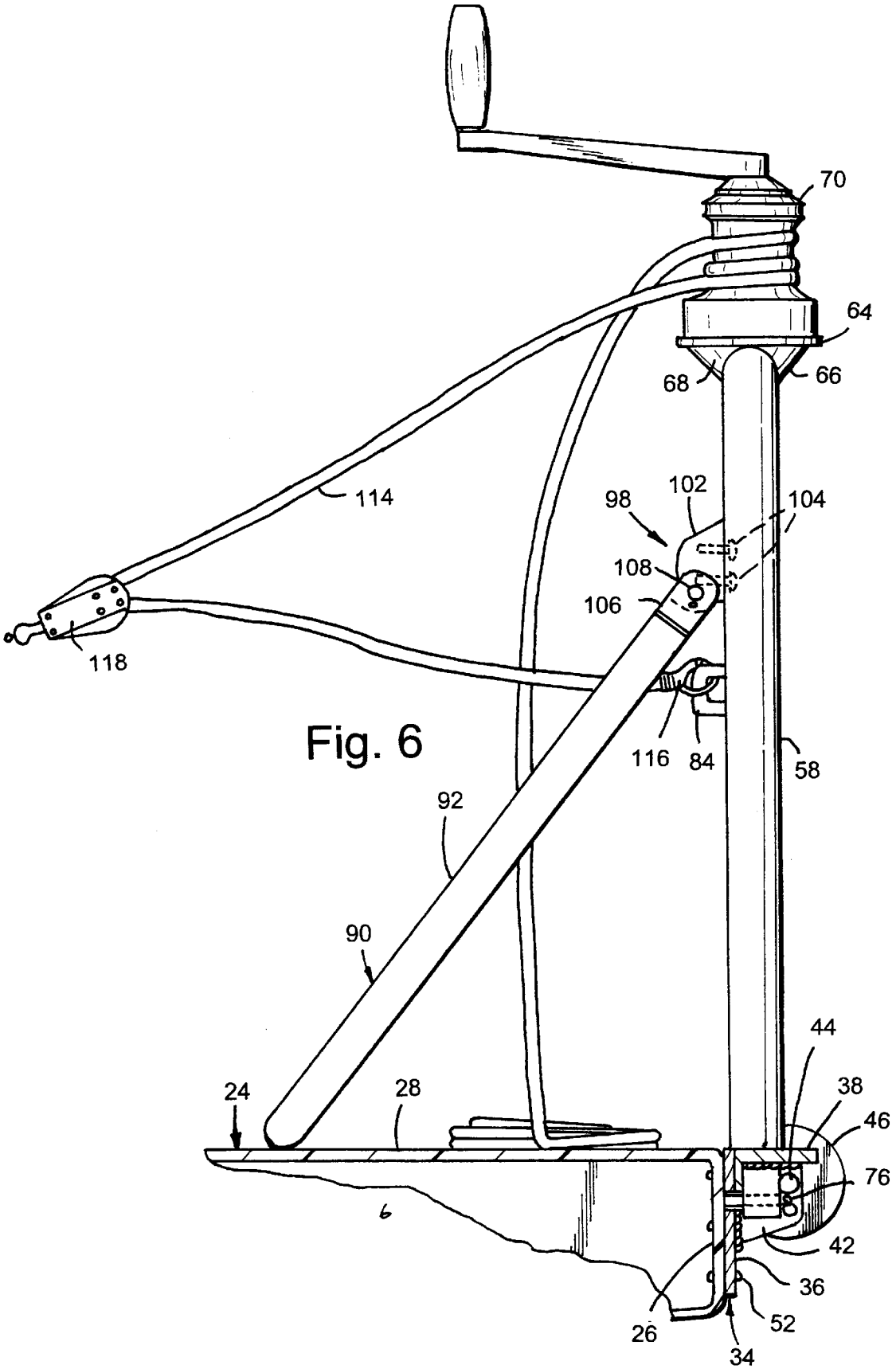
FIG. 6 is a partial sectional rear elevational view of the swim platform and the support framework secured to the roller assembly taken along lines 6—6 of FIG. 3.

The port and starboard roller brackets are substantially identical to one another, and therefore, only the starboard bracket 32 will be described in detail. As seen in FIGS. 3 and 4, the roller bracket 32 comprises a substantially vertical base plate 36, a pair of upper flanges 38, 40 depending outwardly from the top edge of the base plate 36, a pair of axle support plates 42 extending between the base plate 36 and upper flanges 38, 40, an axle 44 supported by the axle support plates 42, and a roller 46 rotatably supported on the axle 44. The base plate 36 is preferably contoured complimentary to the swim platform sidewall 26 and securely fastened thereto by a plurality of conventional fasteners 52 such as screws, bolts or the like. The upper flanges 38, 40 each have a stand aperture 48, 50 provided therein which, as described further below, are adapted to selectively support the winch support stand 34.

The winch support stand comprises a substantially rectangular frame defined by a pair of vertical members 58, 60 and an upper cross member 62 extending between the top edges of the two vertical members 58, 60. Preferably, the framework is formed from conventional aluminum tubing and is welded accordingly. A mounting platform 64 is welded to the top of the upper cross member along with a pair of gusset plates 66, 68 to create a suitable surface for supporting a conventional winch 70. In the preferred embodiment, a two-speed, self-tailing winch, such as a Lewmar™ 30ST winch is secured to the platform 64. Preferably, a retaining ring 84, 86 is provided on each of the vertical members 58, 60, respectively.

The bottom end of each of the vertical members 58, 60 further comprises a mounting stem 72, 74, respectively, depending downwardly therefrom. The mounting stems have a diameter which is less than that of the vertical members 58, 60 and which is slightly less than the diameter of the stand apertures 48, 50 provided in the roller brackets 30, 32. The stems 72, 74 are adapted to be slideably received through the stand apertures 48, 50 of the brackets 30, 32 and retained in this position by conventional ball-lock pins 76, 78. The pins extend through suitable ball-lock apertures 80, 82 provided in the mounting stems 72, 74.

A support arm 90 is rotatably mounted to the vertical members 58, 60 of the framework. The support arm 90 is preferably U-shaped and comprises a pair of opposed members 92, 94 and a bight member 96 extending between bottom ends of the opposed members 92, 94. A pair of pivot members 98, 100 are provided at the upper ends of the opposed members. Each pivot member comprises a support plate 102 which is securely mounted to the vertical member 58 by conventional fasteners 104 and a female pivot pin 106 secured in the hollow ends of the opposed members 58, 60. The female pivot pin 106 is rotatably secured to the support plate 102 by a male pivot pin 108.

The support arm 90 is dimensioned and provided on the rectangular frame so that the support arm 90 extends downwardly and inwardly from the rectangular frame, and the bight member 96 contacts the top surface 28 of the swim platform 24 when the vertical members 58, 60 are fully received in the stand apertures 48, 50 of one of the brackets 30, 32.

In the preferred embodiment of the invention, a roller bracket is provided on the opposed port and starboard sides of the swim platform 24, and the winch support stand 34 is adapted to be received in the stand apertures 48, 50 of either of these two brackets. FIGS. 1–6 show the stand 34 received in the port bracket 30. In this orientation, the personal watercraft would be pulled from the starboard side toward the port side onto the swim platform. However, it is understood that the stand 34 is interchangeable between the port and starboard brackets so that it can also be received in either bracket depending upon the desired orientation of the personal watercraft 54 on the swim platform 24.

In use, a winching line 114 is provided with a conventional snap-shackle 116 at one end thereof, and the snap-shackle 116 is selectively secured to one of the retaining rings 84, 86. A conventional block and shackle 118 is threadably received on the line 114, and the other end of the line is received on the body of the winch 70. The block and shackle 118 are snapped onto a conventional lift ring on the personal watercraft 54 when the personal watercraft 54 is in the water. The winch handle is rotated to reel in the line 114 until the bow of the personal watercraft 54 contacts the roller 46 of the starboard roller bracket 32. As the user continues to rotate the winch handle, the winching line 114 is further drawn in until the personal watercraft 54 is drawn over the roller 46 up onto the swim platform 24. The user continues to reel in the winching line 114 with the mechanical assistance of the winch 70 until the personal watercraft is in the desired position on the swim platform 24.

The personal watercraft storage system is also useful in launching the personal watercraft from the swim platform 24. In order to launch the personal watercraft 54, the user slides the personal watercraft 54 along the top surface 28 of the swim platform 24 until at least a portion of the personal watercraft 54 is received on top of the roller 46. With the winch line looped at least once around the drum of the winch, the user can slowly lower the personal watercraft 54 into the water by slowly easing the winching line while simultaneously sliding the personal watercraft 54 along the roller 46 into the water. Once the personal watercraft 54 is in the water, the block and shackle 118 is removed therefrom.

One unique advantage of the personal watercraft storage system according to the invention is that the bulk of the components of the system can be quickly and easily stored when the system is not in use. As described above, the winch support stand 34 is secured to one of the roller brackets 30, 32 by the ball-lock pins 76, 78. The stand can be quickly and easily separated from the bracket by removing the ball-lock pins and lifting the stand upwardly to disengage the mounting stems 72, 74 from the bracket. The mounting stand is small enough so that it can be easily stored in a locker or other suitable location on the boat. When it is desirable to either raise or lower the personal watercraft the winch support stand 34 can be quickly positioned on the bracket for use.

Although the preferred embodiment of the invention discloses use of a winch 70 for drawing the personal watercraft 50 up onto the swim platform 24, persons skilled in the art will appreciate that any means adapted to provide a mechanical advantage for the user in drawing the personal watercraft up onto the swim platform are acceptable substitutes for the winch and are expressly included within the scope of the invention. Examples of other devices include a windlass, capstan, and block and tackle.

The personal watercraft storage system according to the invention provides several unique advantages over the prior art. First, this system does not include any electrical or hydraulic systems. Secondly, the largest, most cumbersome pieces of the system, namely, the winch support stand 34, can be quickly and easily removed from the bracket and swim platform when not in use. Therefore, the full use of the boat will not be inhibited. Still another advantage of the system is the adaptability depending upon the orientation of the personal watercraft. For example, the winch support stand 34 can be positioned on either the starboard or port side depending upon the desired orientation of the personal watercraft and other limitations such as the position of docks or piers. All of these advantages are achieved with a fairly simple and relatively inexpensive structure.

Reasonable variation and modification are possible within the spirit of the foregoing specification and drawings without departing from the scope of the invention.

The embodiments for which an exclusive property or privilege is claimed are defined as follows:

1. A loading assembly for loading a personal watercraft onto a swim platform of a boat comprising:

a pair of mounting brackets, each including a vertically extending mounting plate for mounting to each side of a swim platform of a boat;

a pair of spaced-apart axle support plates mounted to each of said mounting brackets, an axle, and a roller rotatably mounted by said axle to said support plates;

a generally horizontally extending flange extending from a top edge of said vertically extending mounting plate away from said swim platform, said flange including an aperture formed therein for receiving a vertically extending mounting post; and a winch assembly having a vertically extending mounting post for removably mounting said winch assembly in either one of said mounting brackets for assisting in pulling a personal watercraft onto said swim platform from either side of a boat.

2. The loading assembly as defined in claim 1 wherein said roller comprises a single roller having a diameter which is reduced from opposite ends toward the center of said roller to assist in centering a personal watercraft as it is loaded onto the swim platform.

3. The loading assembly as defined in claim 2 wherein said vertically extending mounting plate includes a plurality of apertures for mounting said mounting bracket to an edge of said swim platform.

4. The loading assembly as defined in claim 3 and further including a locking mechanism removably extending between said mounting post and said mounting bracket for locking said winch assembly to a selected mounting bracket.

5. The loading assembly as defined in claim 4 wherein said vertically extending mounting plate is curved to follow the contour of said swim platform.

6. The combination of a boat and a loading station for loading a personal watercraft onto a swim platform of the boat comprising:

a boat hull with a stern;

a swim platform coupled to said hull and extending aft from said stern, said swim platform having a trailing edge and a pair of opposed sides;

a roller assembly including a roller, said assembly mounted to one of said sides of said swim platform;

a bracket mounted to an opposite side of said swim platform in spaced relationship to said roller; and a winch mechanism removably mounted to said bracket such that said winch mechanism can be used to exert a force on a personal watercraft to draw said personal watercraft over said roller of said roller assembly onto the swim platform for storage on said swim platform behind the stern of said boat.

7. The boat and loading station as defined in claim 6 wherein said roller assembly includes a mounting bracket for attachment to said one of said sides of said swim platform.

8. The boat and loading station as defined in claim 7 wherein said mounting bracket includes a pair of spaced axle support plates and an axle mounted between said plates.

9. The boat and loading station as defined in claim 8 wherein said mounting bracket includes a vertically extending base plate having an upper edge and at least one horizontal flange extending away from said swim platform from said upper edge of said base plate.

10. The boat and loading station as defined in claim 9 wherein said roller comprises a single roller having a diameter which is reduced from opposite ends toward the center of said roller to assist in centering a personal watercraft as it is loaded onto said swim platform by said boat loading station.

11. The boat and loading station as defined in claim 10 wherein said mounting bracket includes a pair of spaced-apart horizontal flanges extending away from said swim platform from said upper edge of said base plate.

12. The boat and loading station as defined in claim 11 wherein said vertically extending base plate includes a plurality of apertures for mounting said mounting bracket to one side of said swim platform.

13. The boat and loading station as defined in claim 12 wherein said vertically extending base plate is curved to follow the contour of said swim platform.

14. A boat loading assembly for loading a personal watercraft onto a swim platform of a boat comprising:

a roller assembly including a roller for mounting to one side of the swim platform;

a first mounting bracket including a vertically extending mounting plate for mounting to an opposite side of a swim platform of a boat, said first mounting bracket including a horizontally extending flange extending from a top edge of said vertically extending mounting plate away from the swim platform and including a pair of spaced-apart apertures formed therein for receiving vertically extending mounting posts; and a winch assembly having a pair of spaced-apart vertically extending mounting posts for removably mounting said winch assembly in said apertures of said flange for assisting in pulling a personal watercraft onto the swim platform.

15. The boat loading assembly as defined in claim 14 wherein said roller assembly includes a second mounting bracket, and wherein said first and said second mounting brackets each include a pair of spaced-apart axle support plates mounted to a vertically extending mounting plate, an axle, and a roller rotatably mounted to said axle for mounting to opposite sides of a swim platform of a boat, said second mounting bracket including a pair of spaced-apart generally horizontally extending flanges extending from a top edge of said vertically extending mounting plate away from said swim platform on opposite sides of said axle support plates, each of said flanges including an aperture formed therein for receiving vertically extending mounting posts, such that said winch assembly can be mounted to either side of said swim platform.

16. The boat loading assembly as defined in claim 15 and further including a locking mechanism removably extending between at least one of said mounting posts and one of said first and second mounting brackets for locking said winch assembly to a selected mounting bracket.

17. The boat loading assembly as defined in claim 16 wherein said vertically extending mounting plate is curved to follow the contour of a swim platform.

18. The boat loading assembly as defined in claim 17 wherein said vertically extending mounting plate of each of said mounting brackets includes a plurality of apertures for mounting said mounting brackets to an edge of said swim platform.

* * * * *